United States Patent [19]

Spanel et al.

[11] 4,111,136

[45] Sep. 5, 1978

[54] YARN CLAMPING APPARATUS

[75] Inventors: Abram N. Spanel, Princeton, N.J.; P. Frank Eiland, Stamford; David R. Jacobs, New Canaan, both of Conn.

[73] Assignee: Abram N. Spanel, Princeton, N.J.

[21] Appl. No.: 811,970

[22] Filed: Jun. 30, 1977

[51] Int. Cl.[2] ..... D05C 15/16

[52] U.S. Cl. ..... 112/79 R; 112/79 FF; 112/261

[58] Field of Search ..... 112/79 R, 79 A, 79.5, 112/79 FF, 80, 227, 222, 261, 226

[56] References Cited

U.S. PATENT DOCUMENTS

| | | | |
|---|---|---|---|
| Re. 27,165 | 8/1971 | Spanel et al. | 112/79 R |
| 1,939,620 | 12/1933 | Ciravolo | 112/261 |
| 2,302,390 | 11/1942 | Nissen | 112/261 |
| 3,554,147 | 1/1971 | Spanel et al. | 112/79 R |
| 3,670,672 | 7/1972 | Spanel et al. | 112/79 R |
| 3,937,159 | 2/1976 | Spanel et al. | 112/79 R |

*Primary Examiner*—H. Hampton Hunter

*Attorney, Agent, or Firm*—J. Rodman Steele, Jr.

[57] ABSTRACT

Yarn clamping means for clamping tufting yarn featuring shield means secured to said yarn clamp which is cooperatively associated with the tufting needle means to prevent impalement of the yarn by the tufting needles.

21 Claims, 7 Drawing Figures

YARN CLAMPING APPARATUS

BACKGROUND OF THE INVENTION

The subject invention may be utilized with various tufting systems, however, it has particular utility when used with one embodiment of the "Spanel tufting system" discussed hereinafter. In the "Spanel tufting system", the use of pneumatic transportation means for the yarn facilitates multicolor selection. In various embodiments of the Spanel techniques, yarn is severed prior to tufting and yarn clamps are necessary to either engage the yarn before it is severed or after it is severed during the actual tufting operation.

Basics of the "Spanel tufting system" are described in existing Spanel patents, including U.S. Pat. No. 3,554,147, which issued to Abram N. Spanel and George J. Brennan on Jan. 12, 1971 and U.S. Pat. No. Re 27,165 which issued Aug. 10, 1971 to Abram N. Spanel and Loy E. Barton.

The aforementioned U.S. Pat. No. Re. 27,165 discloses a pneumatic yarn transport system in which yarn is transported pneumatically to a tufting station where it is applied by tufting elements to a backing. Multi-color selection of the yarn bits is carried out by a magazine which provides yarns of various colors to each of guide tubes wherein the yarn is severed into bits to be transported to tufting elements.

The aforementioned U.S. Pat. No. 3,554,147 describes an alternative system to U.S. Pat. No. Re 27,165 and provides for the simultaneous selection of bit-lengths of yarn of various colors for each tufting cycle at each individual tufting station. A collator structure is utilized in which individual channels transport yarn into a common passageway adjacent the tufting station. In a preferred embodiment, severing takes place in close proximity to the tufting station after a selected yarn strand has been fed into the common passageway.

In U.S. Pat. No. 3,937,159, which issued to Abram N. Spanel on Feb. 10, 1976, various yarn clamping means for tufting apparatus are disclosed. These clamps have utility with either the Spanel (Barton) system of U.S. Pat. No. Re 27,165 or the Spanel (Brennan) system of U.S. Pat. No. 3,554,147.

Yarn clamp structure is also shown in FIGS. 11 and 12 of U.S. Pat. No. 3,670,672, which issued to Abram N. Spanel and John L. Schwartz on June 20, 1972.

In tufting developments which utilize the Spanel concepts, Ellison British Specification No. 1,339,594 discloses a clamp means which may also be used with Spanel-type tufting apparatus.

In a preferred mode of operation of Spanel tufting, as disclosed in co-pending Patent application Ser. No. 811,955, filed concurrently herewith, a yarn adjuster enables a Spanel tufting machine to operate with a tuft length selectivity feature. To improve the operation of the yarn adjuster, it is necessary to prevent the impalement of yarn by the tufting needles which without preventive measures can occur because of the close proximity of the yarn adjuster to the tufting needles.

BRIEF SUMMARY OF THE INVENTION

In accordance with the subject invention, the yarn clamping means disclosed herein is designed to be compatible with the yarn adjuster and similar types of structure as disclosed in co-pending Patent Application Ser. No. 811,955 wherein U-shaped tufts are produced. The yarn adjuster as disclosed in the aforementioned co-pending application enables the selection of yarn bit-lengths of different size of enabling the centering or equalizing of yarn on each side of the tufting needle. In this way, yarn bit-lengths of different size may be selected without changing the relationship of knife position to tufting needles which would otherwise be necessary were it not for the ability to equalize the length of yarn on each side of the tufting needle.

For example, if the yarn severing means is one inch from the tufting needles, then a bit-length of yarn of two inches will provide a tuft with approximate one-inch legs (not counting the portion of yarn between tufting needles when dual needles are utilized). If two inch legs are desired, which means a bit-length of yarn of approximately four inches must be provided, then it is obvious that if the severing means remains at the one-inch distance from the tufting needles, one tuft leg will be one inch while the other tuft leg will be three inches, unless the yarn on each side of the tufting needles is equalized. As disclosed in co-pending Application Ser. No. 811,955, a yarn adjuster in close proximity to the tufting needle (actually placed between the tufting needle and the yarn severing means) is utilized to pull a predetermined amount of yarn from either the yarn feed direction or from what has already been fed through the needle eyes, thus causing the yarn to be equalized on each side of the tufting needles.

In the preferred embodiment, yarn is lifted adjacent the needles and while this operation will enable the selectivity of yarn bit sizes with controlled tuft leg length, there is a likelihood that yarn will become impaled by the closest needle point, unless the yarn is shielded from the points or a point in close proximity to the yarn. Accordingly, a yarn bit clamp has been developed which also includes a needle shield so that yarn is simultaneously secured during the tufting step but nevertheless protected from impalement by the needle point which is in closest proximity to the yarn engaging operation.

Each yarn bit clamp is provided with a shield related to the needle size so that the shield will surround the needle to enable relative reciprocation with needle entering the shield. Typically, the needle may be rectangular in shape and the accompanying shield will also be rectangular in tolerances sufficient to ensure that the needle is reciprocable without interference from the shield when the bit clamp is in clamping position.

BRIEF DESCRIPTION OF THE DRAWINGS

For a more detailed understanding of the invention, reference is made in the following description to the accompanying drawings in which.

DETAILED DESCRIPTION

Figure 1:
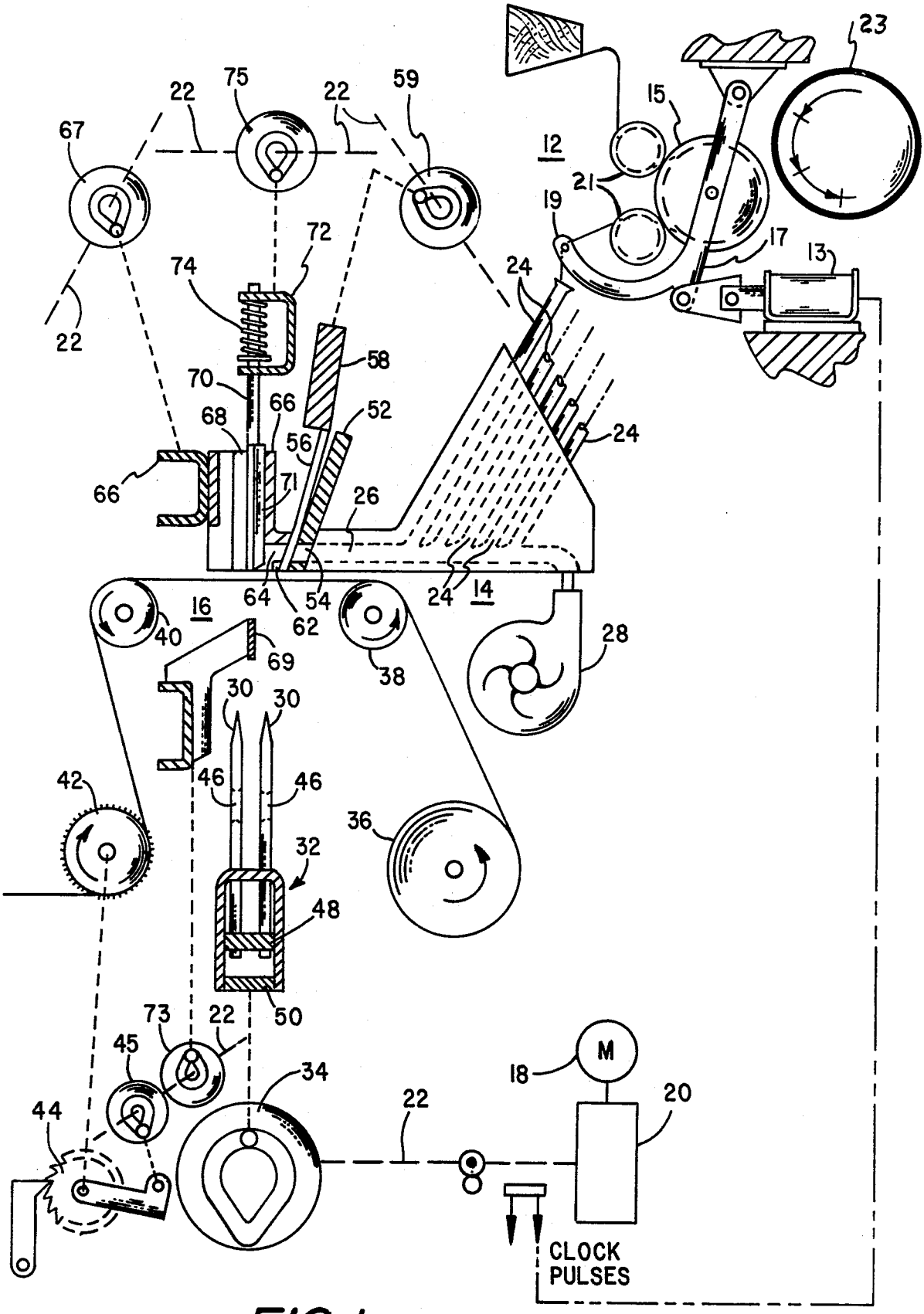
FIG. 1 discloses a schematic view of one embodiment of the tufting apparatus in which the subject yarn clamping means may be utilized.

With reference to FIG. 1, tufting apparatus as disclosed herein includes yarn selection and metering apparatus 12, pneumatic transport apparatus 14, and a tufting station 16. Each tufting station 16 is representative of as many as 1200 such tufting stations and for each tufting station there will be available some five or eight yarn strands each representing a different color or some other variable.

Control signals for operation of each selection actuation means for each selection and metering apparatus may be provided by any of various readout devices. To produce a desired pattern on a backing layer, pattern information recorded on tapes, drums or other medium is converted into electrical or other types of signals which, at the proper time with regard to the machine tufting cycle, as indicated by the dashed clock pulses of FIG. 1, are transmitted to the actuation means 13 for the yarn selection and metering apparatus. The selection actuator 13 may be a solenoid or it may be any suitable one of a variety of electrical, thermal, pneumatic or hydraulic, etc. type actuators. For details of selection and metering in the Spanel tufting system aforementioned U.S. Pat. Nos. 3,554,147 and Re 27,165 should be consulted as well as U.S. Pat. No. 3,937,157 of which Abram N. Spanel and David R. Jacobs are inventors and co-pending Application Ser. No. 699,904. A rotatable yarn feed mechanism 15 which may be on the order of that disclosed in U.S. Pat. No. 3,937,157 is shown in FIG. 1 together with intermediate linkage means 17 which extends from actuator 13 to rotatable yarn feed mechanism 15 and which also controls the yarn pull-back mechanism 19 fully described in U.S. Pat. No. 3,937,157. The yarn feed mechanism also includes yarn guides 21 and drive roll 23. The selection and metering system including yarn pull-back means of co-pending Application Ser. No. 699,904 may be used as well as the rotatable yarn feed mechanism.

A motor 18 is shown driving the machine by means of drive transmission 20 which may be a train of gears or comprise other mechanisms. A shaft 22 is schematically shown running throughout the device from which drive mechanism operate as will be described subsequently.

Briefly, specific color selection signals are generated in response to the color requirements of a desired pattern, and for each of the color selection signals transmitted to a selection actuation means 13, a predetermined length of selected yarn is metered by yarn selection and metering apparatus 12 and advanced by pneumatic transport apparatus 14 through yarn guide tubes 24 so that the selected yarn strand extends into a common passageway 26 leading to tufting station 16 where it will be cut and the resultant yarn bit tufted into backing layer L. A pneumatic source 28 schematically shown provides the pneumatic supply for pneumatic transport apparatus 14. Reference may once again be made to U.S. Pat. No. 3,937,157 or co-pending Application Ser. No. 699,904 for suitable pneumatic systems. The pull back mechanism 19 which is part of the yarn selection and metering apparatus 12 will remove the last-selected yarn strand from the common passageway 26 adjacent the tufting station after severance of the yarn bit, preparatory to the next color selection by the control signals.

At the tufting station, tufting needles 30 with aligned eyes receive the yarn strands preparatory to tufting. The needles 30 are mounted on a needle bar 32 which via cam drive 34 provides reciprocable motion to the needles 30.

The backing L may be fed from a supply roll 36 over roller member 38. Idler roll 40 directs the tufted product to the take-up pin roll 42 which operates from the ratchet and pawl mechanism 44 functioning off cam drive 45.

Figure 2:
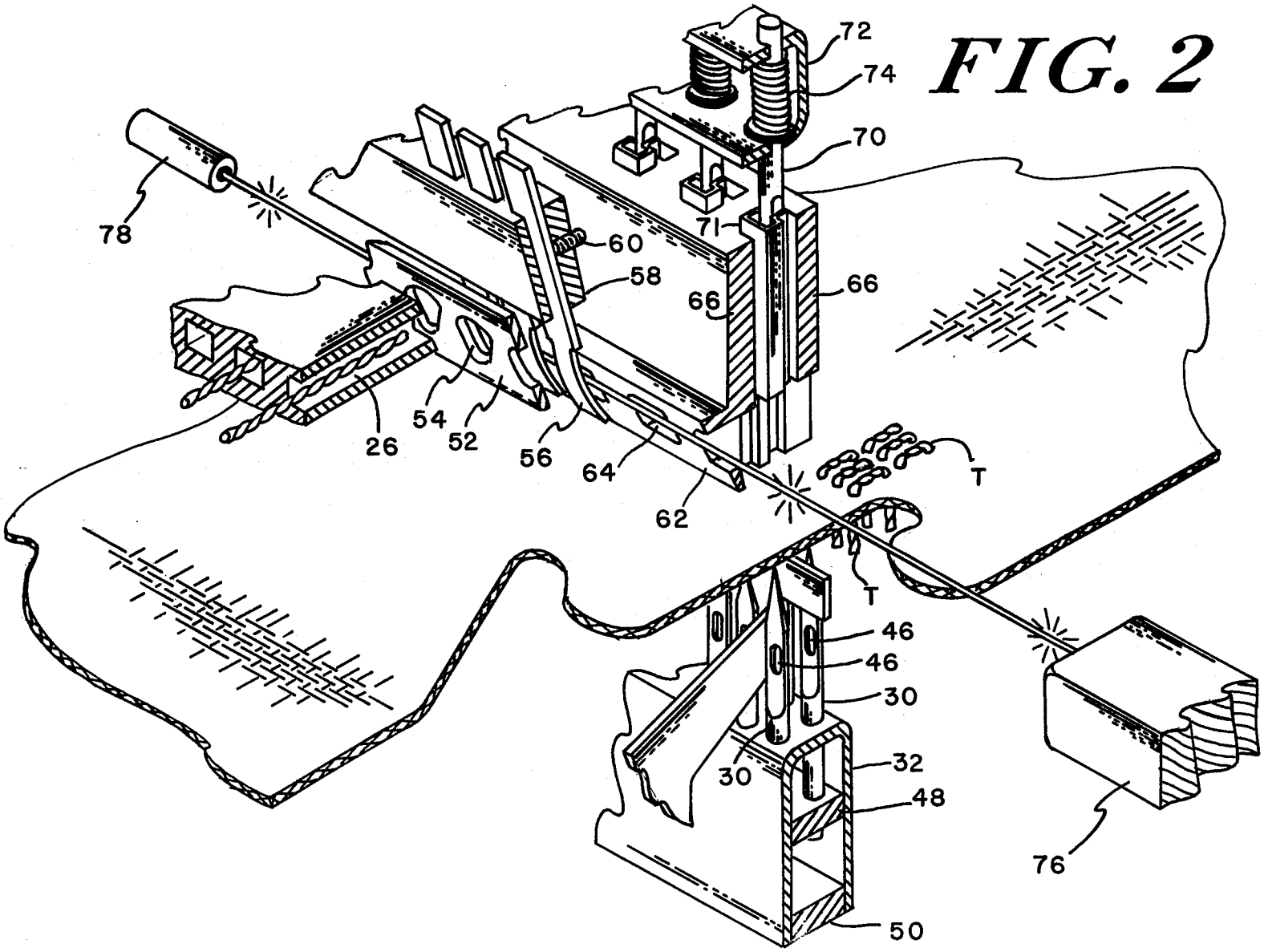
FIG. 2 is a perspective view showing a tufting station together with the yarn clamping means.

With reference to FIG. 1 and FIG. 2, the tufting station 16 is shown comprising needles 30 which have aligned eyes 46. Each individual tufting station comprises dual needles 30 on the order of those disclosed in aforementioned Reissue Patent Re. 27,165. A needle bar 32 of lightweight construction aligns the needles 30 which are secured within the needle bar by needle bar insert member 48. A needle bar base plate 50 serves as mounting means for standard linkage structure which will drive the needle bar 32 by cam drive 34.

With further reference to FIGS. 1 and 2, a cutter mechanism stationary blade 52 having openings 54 is positioned adjacent common passageway 26 through which yarn extends toward each tufting station 16. Immediately adjacent the stationary blade 52, reciprocating blades 56 are positioned which are secured to reciprocating blade holder 58 which reciprocates in a widthwise direction with respect to the machine. This reciprocation is shown schematically as being provided by cam 59 in FIG. 1. Each individual reciprocating blade 56 is secured to reciprocating blade holder 58 by a locking and adjustment means 60 which may be on the order of a set screw device.

Adjacent the reciprocating blades, yarn adjuster 62 is shown having yarn openings 64 which align with the openings 54 of the stationary blade 52 to enable yarn strands to be pneumatically fed through to the tufting needles 30. The yarn adjustor 62 provides the tufting apparatus with the capability of selecting and tufting yarn of different lengths to produce rugs of different pile heights either on the same or different rugs. With reference to FIG. 2, U-shaped tufts are disclosed and it can be appreciated from FIGS. 1 and 2 that if different yarn lengths are metered by the yarn selection and metering apparatus 12 in the absence of some adjustment means, unequal tufts will result which will be of the nature of J-shaped rather than U-shaped since more or less yarn will be fed to the right of the needles 30 than the amount of yarn to the left of the needles 30 between the needles 30 and the cutting mechanism. Thus in constructing the apparatus disclosed herein, it is preferred to have the distance between the needles 30 and the reciprocating blade 56 be equal to the shortest tuft-leg length that will be produced on the machine. If longer tufts are desired, the additional necessary yarn is advanced by the metering means 12 and pneumatically fed to the needles 30 with the additional yarn being fed to the right of the needles 30. The yarn adjuster 62 will then rise lifting the yarn and pulling back one half of the additional yarn to the left of the needles prior to severance by the reciprocating blade 56 so that each tuft-leg will be equal and U-shaped tufts will result. It will be appreciated that the above designations of right and left of the needles were directed to the view as shown in FIG. 2. The terms should be reversed when viewing FIG. 1.

Yarn adjuster carrier bar 66 is shown being an integral part of the yarn adjuster 62 and vertical reciprocation of the yarn adjuster carrier bar 66 is enabled through linkage by eccentric member 67 schematically shown in FIG. 1.

Yarn bit clamps 70 are shown which clamp the yarn against the backing layer L prior to tufting by the needles 30 and before, during or after severance of the yarn. A shiftable support member 69 is provided opposite the backing layer L from the clamps 70 to provide support for the backing layer. The support member 69 is controlled by cam member 73 and is cleared from its support position as the backing layer L is advanced.

The yarn bit clamp 70 is shown having hollow shields 71 into which extend the needle 30 of each needle pair which is closest to the yarn adjuster 62. The shield serves to prevent impalement of the yarn by the shielded needle 30 as it descends in close proximity to the yarn adjuster 62.

The yarn adjuster carrier bar 66 is shown having channels 68 through which the bit clamps 70 are permitted to reciprocate as does yarn adjuster carrier bar 66 although independent of each other. The bit clamps 70 are secured to bit clamp carrier bar 72 which is shown housing spring means 74 supported by flange support 148 for each of the individual bit clamps 70. As shown in FIG. 1, cam 75 provides the vertical reciprocation for carrier bar 72.

A laser 76 is shown which will be positioned on one extreme side of the machine while a photo detector 78 will be positioned at the opposite side of the laser aligned therewith so that the laser beam may be used to detect the presence of yarn in any of the channels at a time when such yarn should not be present. The presence of yarn at such a time indicates a malfunction.

Figure 3:
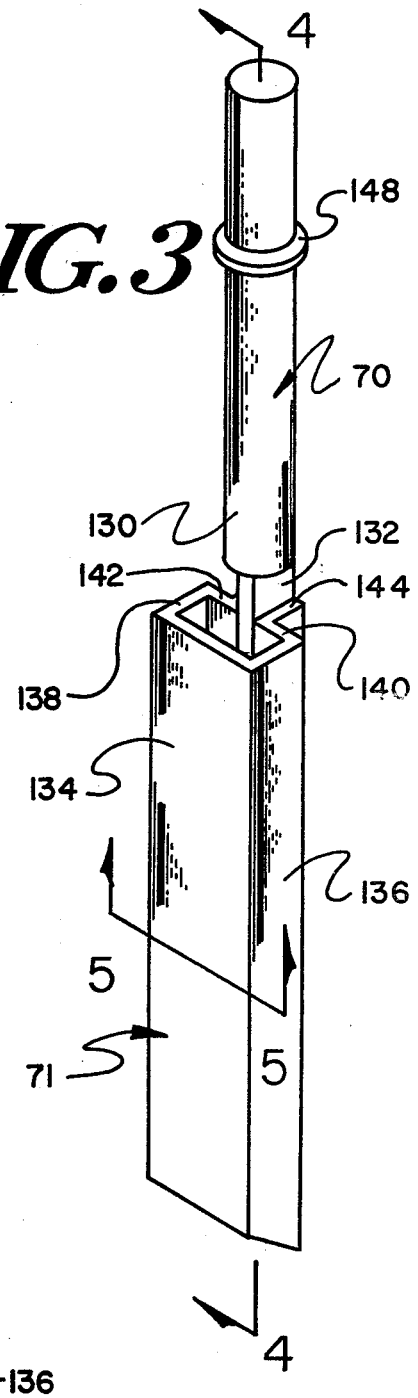
FIG. 3 is a perspective view showing the yarn bit clamp together with the needle shield.

With reference to FIG. 3, the yarn bit clamp 70 is shown comprising an upper substantially cylindrical portion 130 and a lower substantially rectangular portion 132. Shield 71 may be constructed of metal or plastic but is preferably a 0.01 inch thick stainless steel member comprising a shield front 134 having shield sides 136, 138 and inwardly facing ends 140 and 142. Attachment arms 144, 146 integral with the remaining shield structure may be used to weld, solder or otherwise attach the shield to rectangular portion 132 of the bit clamp.

Figure 4:
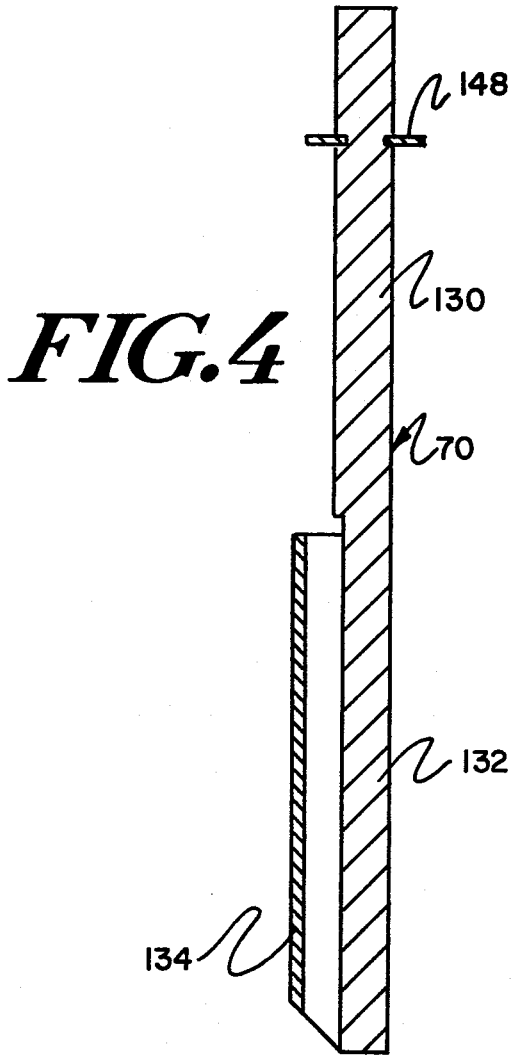
FIG. 4 is a cross-sectional side view taken along the lines 4—4 of FIG. 3.

An inset flange 148, which may be a C type snap ring secured as seen in FIG. 4, may be utilized to retain the yarn bit clamp 70 within bit clamp carrier bar 72. As can be seen from FIG. 1, the flange 148 accomplishes two purposes. It forms the stop for the downward motion to prevent the bit clamp 70 from descending further than permitted by bit clamp carrier bar 72. The flange 148 also forms a foot or base for the spring 74 to bear against.

With respect to the construction of the bit clamp assembly, it will be appreciated that an ideal way to assemble the individual bit clamps 70 with the bit clamp carrier bar 72 is to first place spring 74 in through the open side face of the carrier bar 72. The open side face of carrier bar 72 both facilitates assembly and lightens the weight of the bar 72. Next the bit clamp 70 without the ring or flange 148 is pushed up through an opening in the bottom of the bit clamp carrier bar 72 within spring 74 and up through the corresponding opening in the top of the carrier bar 72 (see FIG. 2). A spring lifter tool may be utilized to compress the spring upwardly to expose a notch in bit clamp 70 where a snap ring is placed and locked in position to form flange 148. Standard crescent rings may be used to form flanges 148.

Figure 5:
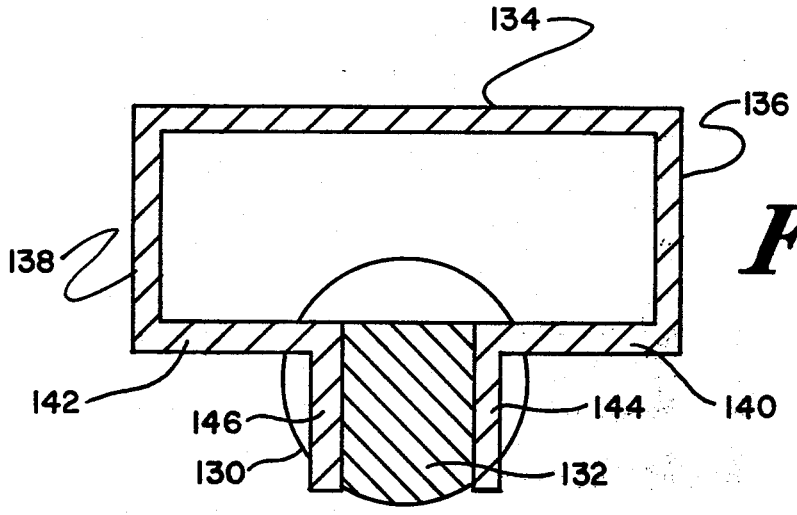
FIG. 5 is a cross-sectional top view taken along the lines 5—5 of FIG. 3.

As noted previously, with reference to FIGS. 3, 4 and 5, the upper portion 130 of bit clamp 70 is substantially cylindrical while the lower portion 132 is substantially rectangular. The lower portion 132 has been made rectangular to fit within a rectangular opening through the yarn adjuster carrier structure 66. The upper portion 130 is preferably cylindrical since this permits rotation about its axis to enable alignment as for example with the yarn adjuster 66 during assembly.

Figure 7:
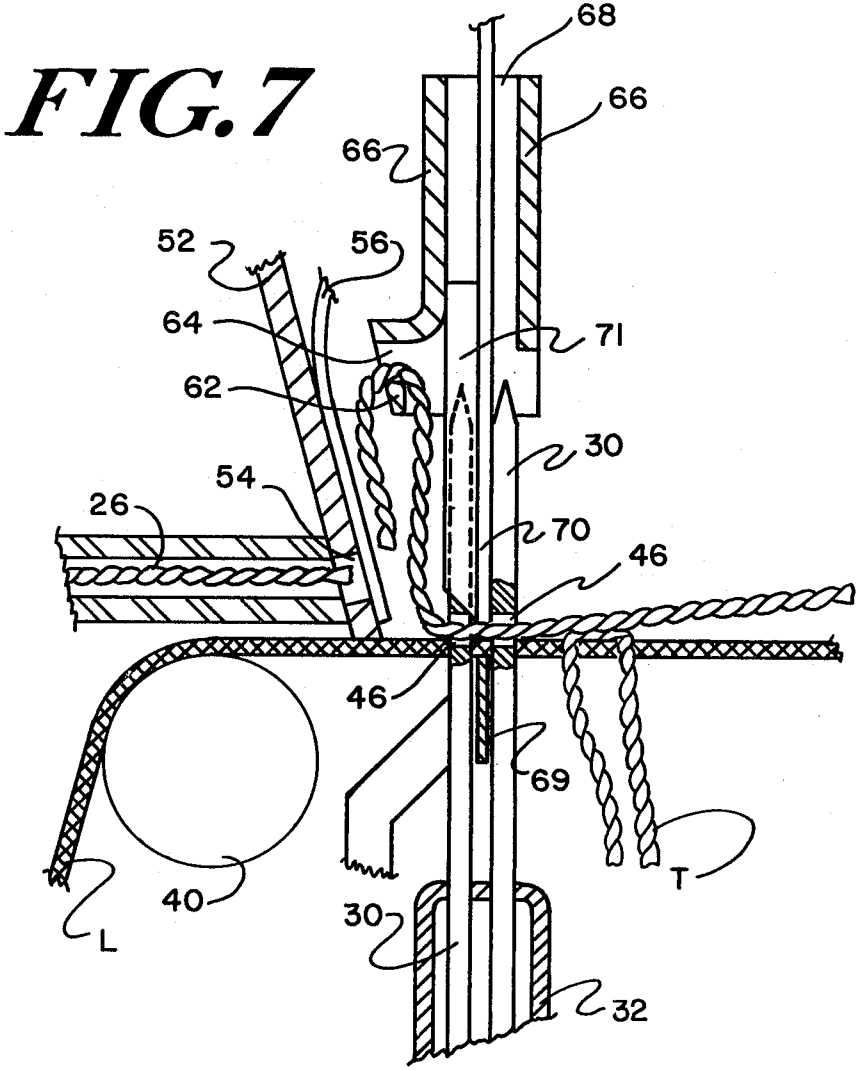
FIG. 7 shows the tufting needles descending with the yarn clamp in its clamping position.
Figure 6:
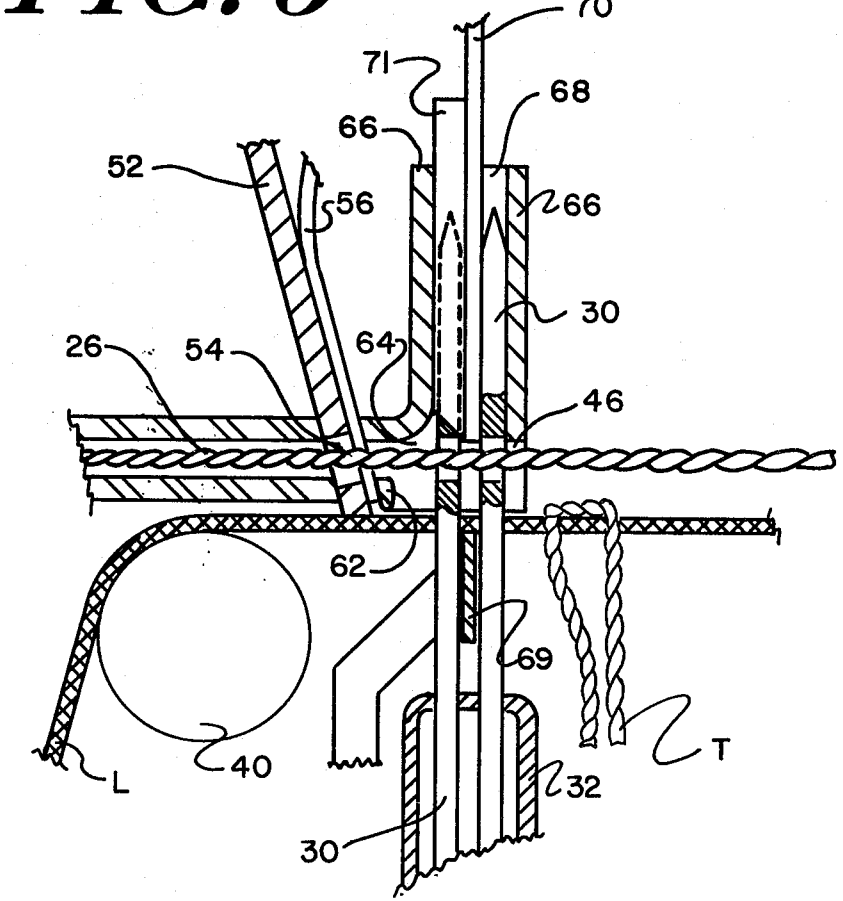
FIG. 6 is a cross-sectional side view of a tufting station showing yarn being loaded into the needles with the yarn bit clamp in its unclamped position.

With reference to FIGS. 6 and 7, portions of the tufting operation are sequentially shown with the bit clamp 70 in operation. As can be seen in FIG. 6, the bit clamp 70 is in its unclamped position and the needles 30 have been raised to their load position with their aligned eyes 46 aligned with the opening 64 of yarn engager 62, the opening 54 of stationary blade 52, and the common passageway. Yarn is shown in a loaded position. A tuft T from the previous cycle is shown implanted in backing layer L.

As can further be seen from FIG. 6, the needle 30 on the left side which is closest to yarn adjuster 62 is shielded within yarn shield 71 which completely surrounds the upper shank portion of the left needle 30.

With reference to FIG. 7, the yarn clamp 70 has descended and is shown clamping the yarn against the backing layer as supported by support member 69. Reciprocating blade 56 has reciprocated severing a yarn bit from the remainder of the strand with this step occurring after yarn adjuster 62 has raised to its predetermined position so as to equalize the yarn on each side of the needles 30. The needles 30 are shown beginning their descent and as can be seen, the shield 71 protects the yarn which is extending over yarn adjuster 62 from the needle point of the left-hand needle which is within shield 71 where it will remain until the needle point passes through the backing layer L.

The yarn may be clamped as soon as yarn adjuster 62 reaches its final predetermined position in the cycle. With respect to the severing, the time of clamping may be before, during or after the severing.

The needles will reach their down position as shown in FIG. 2 and the yarn clamp 70 will be raised preparatory to the needles raising once again to their load position.

The spring means 74 serves the purpose generally of the various resilient means set forth in U.S. Pat. No. 3,937,159 which issued on Feb. 10, 1976 to Abram N. Spanel. Essentially, during the clamping operation, the carrier bar 72 will go down further than the individual bit clamp 70 needs to so that the spring 74 serves to limit the amount of pressure placed on the yarn by the clamps 70. By utilizing this type of device, the clamps 70 may be used to operate on different thicknesses of yarn.

In this respect, it will be appreciated that if the bit clamp 70 were rigidly affixed to the carrier bar 72, the lower end of the bit clamps 70 would be uniform across the machine so that if yarn in the first needle station was ⅛th of an inch in diameter and yarn in the second needle station was only 1/16th of an inch in diameter, quite possibly considerable pressure would be placed on the yarn in the first tufting station with very little or no pressure on the yarn in the second needle station. By spring loading the bit clamps 70 individually and lowering the carrier bar 72 during the clamping operation more than necessary, it becomes assured that essentially the same pressure will be exerted on each yarn in each tufting station.

Co-pending application Ser. Nos. 811,955; 811,956; 810,968 and 811,969; filed concurrently herewith should be consulted for further description of the cutter mechanism 52, 56, laser detector 76, 78, yarn adjuster 62 and needle bar 32 construction.

The present invention may be embodied in other specific forms without departing from the spirit or essential attributes thereof, and, accordingly, reference should be made to the appended claims, rather than to the foregoing specification as indicating the scope of the invention.

What is claimed is:

1. Tufting apparatus or the like including:

bit-applying means including tufting needles for applying tufts to a backing layer wherein the improvement comprises clamping means associated with said bit-applying means to clamp yarn once loaded in said bit-applying means, said clamping means including shield means to shield said yarn from being impaled by said needles.

2. The tufting apparatus or the like of claim 1 wherein said clamping means is reciprocatory.

3. The tufting apparatus or the like of claim 1 further comprising a means for severing yarn into a yarn bit subsequent to said yarn being loaded in said bit-applying means, said clamping occurring either, before, during or after severing.

4. The tufting apparatus or the like of claim 1 wherein the yarn is pneumatically fed to said bit-applying means before said clamping means clamps the yarn.

5. The tufting apparatus or the like of claim 1 further including a yarn adjuster for adjusting yarn once loaded in said bit-applying means, said clamping means being utilized to clamp the yarn after adjustment thereof.

6. The tufting apparatus or the like of claim 1 wherein said clamping means includes a spring positioned to bias the clamp toward yarn to be clamped.

7. The tufting apparatus or the like of claim 6 wherein tufting needles are placed in pairs and clamping means is utilized between each needle pair.

8. The tufting apparatus or the like of claim 7 wherein the yarn shield surrounds at least one of the needles of each of said pair.

9. The tufting apparatus or the like of claim 1 further including yarn selection and metering means by which one of a series of yarns is selected for each bit-applying means and a predetermined amount of yarn is metered prior to the yarn being loaded and clamped in each of said bit-applying elements.

10. The tufting apparatus or the like of claim 1 wherein at each tufting station the clamping means comprises a clamping member with said shield being secured to its lower portion.

11. The tufting apparatus or the like of claim 10 wherein the lower portion of each of said clamping elements is substantially rectangular and the upper portion substantially cylindrical.

12. The tufting apparatus or the like of claim 11 wherein the upper portion of each of said clamping members is mounted within a clamp carrier bar.

13. The tufting apparatus or the like of claim 12 wherein the upper portion of each of said clamping members includes a flange for securing said upper portion within said carrier bar.

14. The tufting apparatus or the like of claim 13 wherein said clamp carrier bar is hollow and each clamping element has a biasing spring associated therewith and contained within said clamping bar.

15. The tufting apparatus or the like of claim 14 wherein said clamp carrier bar has at least one open side to facilitate construction.

16. A method of tufting comprising the steps of pneumatically feeding yarn to and loading tufting needles;

clamping the yarn loaded in said tufting needles;

shielding the yarn from being pierced by said tufting needles;

severing the yarn into a yarn bit; and tufting the yarn bit.

17. The method of tufting of claim 16 further comprising the step of selecting one of a series of yarns for each of a number of tufting stations and metering a predetermined amount of the selected yarn.

18. The method of tufting of claim 16, further including the step of adjusting the position of the yarn once loaded in said tufting needles prior to the step of clamping.

19. Tufting apparatus or the like comprising tufting needles for applying yarn to a backing layer;

means of pneumatically transporting yarn to said tufting needles;

means for severing yarn into yarn bits when the yarn is loaded in the tufting needles, said severing means positioned adjacent said tufting needles; and clamping means to clamp the yarn loaded in said tufting needles said clamping means including shielding means to prevent the impalement of the yarn on said tufting needles.

20. The tufting apparatus or the like of claim 19 wherein said tufting needles are secured to a tufting needle bar and wherein said clamping means are secured to a clamping drive bar and further wherein said tufting needle bar is located on an opposite side of the backing layer from said clamping drive bar.

21. The tufting apparatus or the like of claim 20 wherein when said tufting needles reach a loading position, at least some of the needle points are surrounded by shields of said clamping means.

* * * * *